US010873152B2

(12) United States Patent
Kang et al.

(10) Patent No.: US 10,873,152 B2
(45) Date of Patent: Dec. 22, 2020

(54) CONNECTOR AND METHOD OF MANUFACTURING THE CONNECTOR

(71) Applicant: Tyco Electronics AMP Korea Co., Ltd., Gyungsan-si (KR)

(72) Inventors: Geon Gu Kang, Gyungsan-si (KR); Gi Chan Kwon, Gyungsan-si (KR); Sung Jun Choi, Gyungsan-si (KR)

(73) Assignee: Tyco Electronics AMP Korea Co., Ltd., Gyungsan-Si (KR)

( * ) Notice: Subject to any disclaimer, the term of this patent is extended or adjusted under 35 U.S.C. 154(b) by 0 days.

(21) Appl. No.: 16/583,856

(22) Filed: Sep. 26, 2019

(65) Prior Publication Data

US 2020/0106210 A1 Apr. 2, 2020

(30) Foreign Application Priority Data

Sep. 28, 2018 (KR) ..... 10-2018-0116230

(51) Int. Cl.

| | |
|---|---|
| ***H01R 13/52*** | (2006.01) |
| ***H01R 13/6592*** | (2011.01) |
| ***H01R 43/00*** | (2006.01) |
| ***H01R 43/20*** | (2006.01) |
| ***H01R 13/506*** | (2006.01) |

(52) U.S. Cl.

CPC ..... *H01R 13/5205* (2013.01); *H01R 13/506* (2013.01); *H01R 13/6592* (2013.01); *H01R 43/005* (2013.01); *H01R 43/20* (2013.01)

(58) Field of Classification Search

CPC ..... H01R 13/5205; H01R 13/5208; H01R 13/5221

See application file for complete search history.

(56) References Cited

U.S. PATENT DOCUMENTS

| | | | | |
|---|---|---|---|---|
| 5,911,599 A * | 6/1999 | Masuda | ..... | H01R 13/6592 439/578 |
| 6,913,486 B2 * | 7/2005 | Nagayasu | ..... | H01R 13/5208 439/587 |
| 9,537,231 B2 | 1/2017 | Hall et al. | | |
| 9,577,367 B2 | 2/2017 | Campbell et al. | | |

FOREIGN PATENT DOCUMENTS

| | | |
|---|---|---|
| JP | 2921634 B2 | 7/1999 |
| JP | 2015-201445 A | 11/2015 |
| KR | 10-2017-0082589 A | 7/2017 |
| KR | 10-2018-0092832 A | 8/2018 |

OTHER PUBLICATIONS

Korean Office Action, dated Jun. 28, 2019, 5 pages.
Abstract of KR20180092832, dated Aug. 20, 2018, 1 page.
Abstract for application also published as JP2921634-JPH07153529, dated Jul. 19, 1999, 1 page.

* cited by examiner

*Primary Examiner* — Ross N Gushi
(74) *Attorney, Agent, or Firm* — Barley Snyder

(57) ABSTRACT

A connector includes a connector housing and a cable assembly configured to be inserted into the connector housing and fixed to the connector housing. The cable assembly has a cable, a terminal portion configured to electrically connect the cable to an external terminal, and a sealing assembly pressed into an outer sheath of the cable and forming a watertight seal with the cable. The sealing assembly is disposed separately from the terminal portion. The cable assembly is elastically connected to a first fastening portion of the connector housing.

18 Claims, 7 Drawing Sheets

CONNECTOR AND METHOD OF MANUFACTURING THE CONNECTOR

CROSS-REFERENCE TO RELATED APPLICATION

This application claims the benefit of the filing date under 35 U.S.C. § 119(a)-(d) of Korean Patent Application No. 10-2018-0116230, filed on Sep. 28, 2018.

FIELD OF THE INVENTION

The present invention relates to a connector and, more particularly, to a connector with a watertight seal.

BACKGROUND

A connector includes a male connector and a female connector which are connected to respective ends of cables. The connector is configured to form an electrical connection between the two cables through a connection between the male connector and the female connector. In certain applications, the connector needs waterproofing to prevent water or moisture from permeating into the connector. The connector also needs a connected cable to be connected robustly and stably to the connector.

SUMMARY

A connector includes a connector housing and a cable assembly configured to be inserted into the connector housing and fixed to the connector housing. The cable assembly has a cable, a terminal portion configured to electrically connect the cable to an external terminal, and a sealing assembly pressed into an outer sheath of the cable and forming a watertight seal with the cable. The sealing assembly is disposed separately from the terminal portion. The cable assembly is elastically connected to a first fastening portion of the connector housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
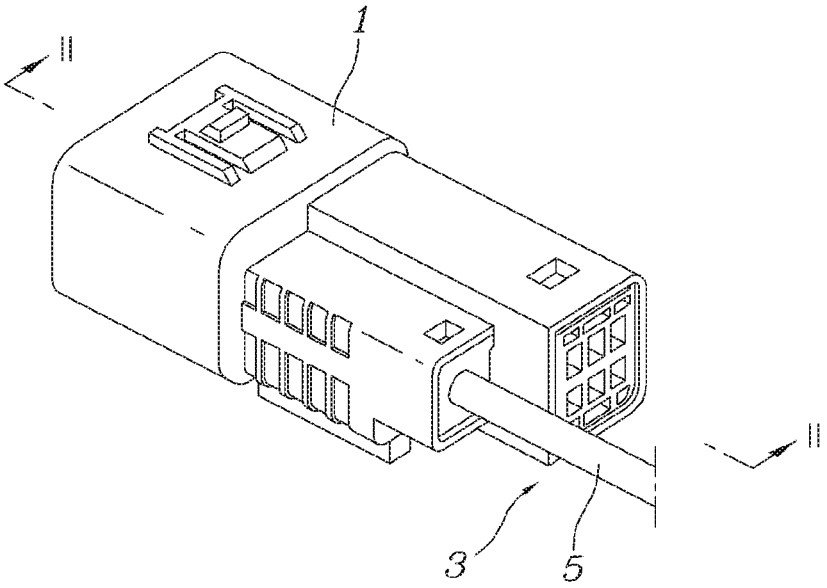
FIG. 1 is a perspective view of a connector according to an embodiment.

The following detailed description is to provide an understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Terms such as first, second, A, B, (a), (b), and the like may be used herein to describe components. Each of these terminologies is not used to define an essence, order, or sequence of a corresponding component but used merely to distinguish the corresponding component from other component(s). For example, a first component may be referred to as a second component, and similarly the second component may also be referred to as the first component.

It should be noted that if it is described in the specification that one component is "connected," "coupled," or "joined" to another component, a third component may be "connected," "coupled," and "joined" between the first and second components, although the first component may be directly connected, coupled or joined to the second component. In addition, it should be noted that if it is described in the specification that one component is "directly connected" or "directly joined" to another component, a third component may not be present therebetween. Likewise, expressions, for example, "between" and "immediately between" and "adjacent to" and "immediately adjacent to" may also be construed as described in the foregoing.

Unless otherwise defined, all terms, including technical and scientific terms, used herein have the same meaning as commonly understood by one of ordinary skill in the art to which this disclosure pertains based on an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings.

A connector according to an embodiment, as shown in FIGS. 1-8, comprises a connector housing 1 and a cable assembly 3 to be inserted into the connector housing 1 and fixed thereto. Once the cable assembly 3 is pressed into the connector housing 1 from the position shown in FIG. 8, the cable assembly 3 is stably fixed to the connector housing 1 to be locked thereto and simultaneously is sealed in a watertight manner. The connector, in various embodiment, may be a male connector or a female connector.

The cable assembly 3, as shown in FIGS. 1-8, includes a cable 5, a terminal portion 9 configured to electrically connect the cable 5 to an external terminal, and a sealing assembly 7 configured to be pressed into an outer sheath of the cable 5 to be watertightly sealed and elastically connected to a first fastening portion 17 of the connector housing 1 and locked thereto. The terminal portion 9 includes a center contact 9*a*, a shield contact 11, and a shield housing 13, which are to be described in detail hereinafter. The terminal portion 9 is fixedly disposed on the cable 5.

Figure 2:
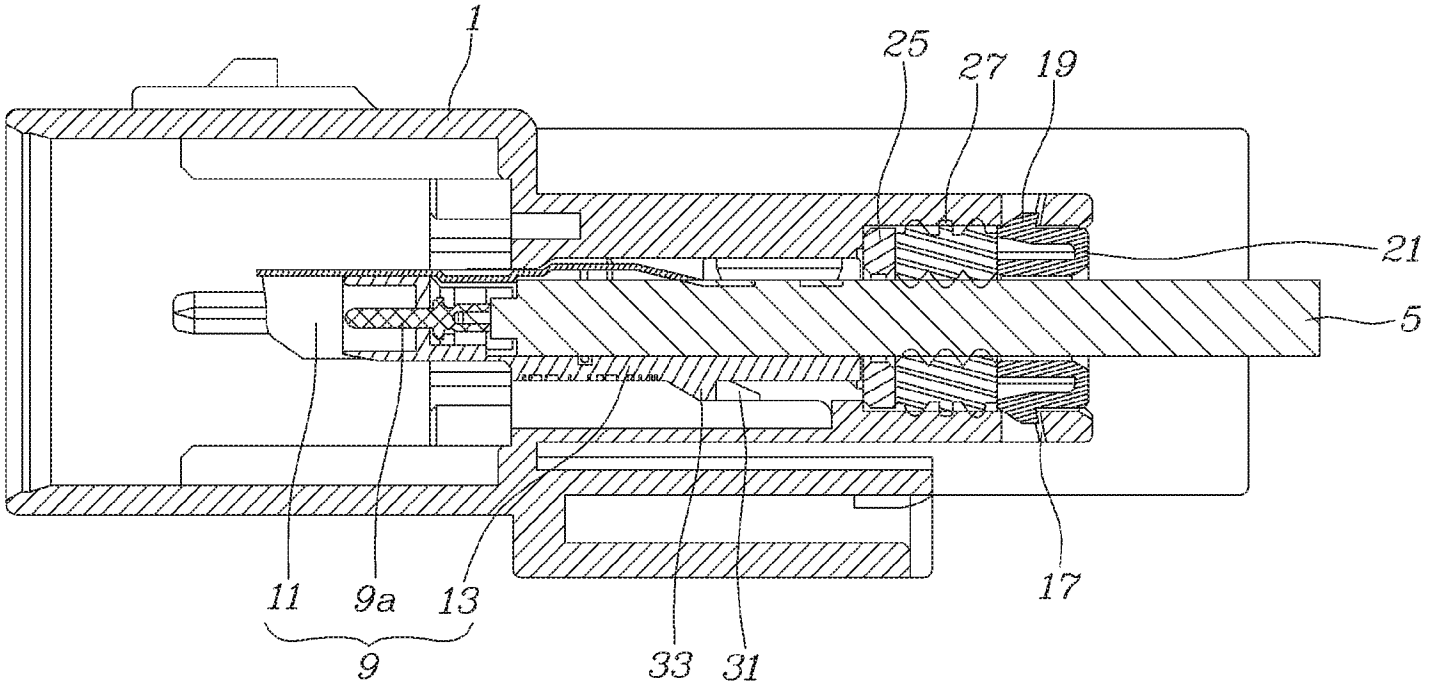
FIG. 2 is a sectional side view of the connector, taken along line II-II of FIG. 1.

The sealing assembly 7 is disposed separately from the terminal portion 9. The sealing assembly 7 is configured to slide along the cable 5 while remaining watertightly sealed on the outer sheath of the cable 5; the sealing assembly 7 is configured to move relative to the terminal portion 9. The sealing assembly 7, as shown in FIGS. 2 and 3, includes a main body 21 including a main hole 15 in a central portion thereof through which the cable 5 passes and in which a first fastener 19 to be elastically connected to the first fastening portion 17 is integrally formed to face the first fastening portion 14 with respect to the main hole 15, a sub body 25 including a subhole 23 in a central portion thereof through which the cable 5 passes and configured to be connected to the main body 21, a seal 27 interposed between the main body 21 and the sub body 25 and configured to be pressed into the outer sheath of the cable 5 to be watertightly sealed, and a plurality of connecting rods 29 of which both ends pass through the seal 27 to be fixed to the main body 21 and the sub body 25, such that the main body 21, the seal 27, and the sub body 25 are connected together.

In an embodiment, a rigidity of the main body 21 and the sub body 25 is greater than that of the seal 27. The seal 27 may be formed with a flexible and elastic material, for example, silicon and/or rubber. The main body 21 and the sub body 25 may be formed with a more rigid material, for example, plastic and/or metal. A diameter of each of the main hole 15 and the sub hole 23 is formed to be greater than that of the cable 5 such that the main hole 15 and the subhole 23 are not in direct contact with the cable 5. In an embodiment, a diameter of a cable hole 27*b* formed in the seal 27 and through which the cable 5 passes is smaller than that of the cable 5 to form a watertight sealing structure.

Figure 3:
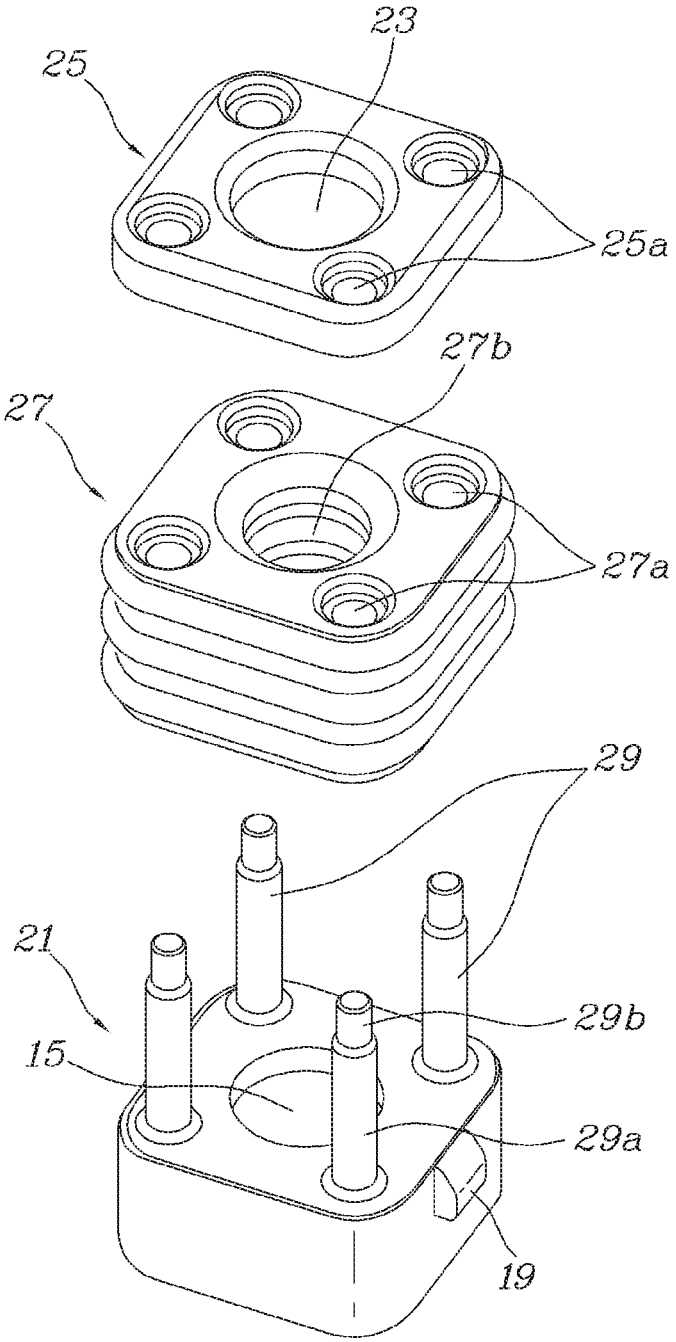
FIG. 3 is a exploded perspective view of a sealing assembly of the connector.

As shown in FIG. 3, the connecting rods 29 are integrally formed with the main body 21 and protrude parallel to each other from an area around the main hole 15 towards an area around the subhole 23 of the sub body 25. End portions of the connecting rods 29 pass through the sub body 25 are fixed to the sub body 25 through heat caulking. In another embodiment, the connecting rods 29 are not integrally formed with the main body 21, but are connected to the main body 21 through various methods including, for example, heat caulking on a side of the main body 21, heat fusion, and screw connection.

Figure 4:
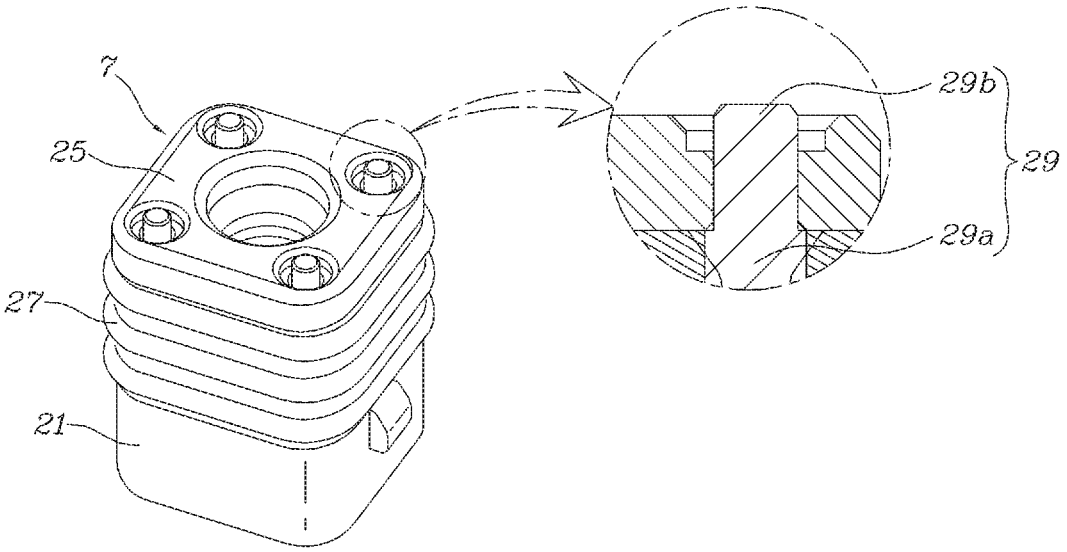
FIG. 4 is a perspective view of the sealing assembly in a pre-assembly state.

As shown in FIGS. 3 and 4, the seal 27 includes a body hole 27*a* passing through the seal 27 along in a longitudinal direction of the cable 5, and the sub body 25 includes a tip hole 25*a* passing through the sub body 25 along in the longitudinal direction of the cable 5. Each of the connecting rods 29 includes a rod body 29*a* extending from the main body 21 and to be inserted into the body hole 27*a*, and a rod tip 29*b* extending from the rod body 29*a* and to be inserted into the tip hole 25*a*. In the shown embodiment, at least a portion of the rod tip 29*b* that passes through the sub body 25 is widened and deformed in a radial direction through heat caulking and is fixed to the tip hole 25*a*.

Figure 5:
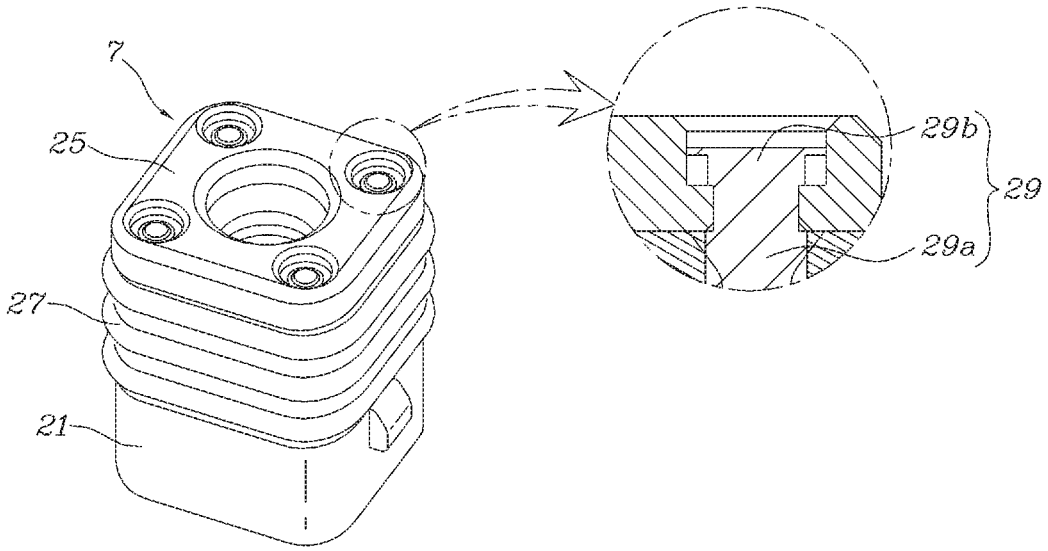
FIG. 5 is a perspective view of the sealing assembly in an assembled state.

When the main body 21, the seal 27, and the sub body 25 are assembled from the pre-assembly state shown in FIG. 3 to the assembled state of FIG. 4, an end portion of the connecting rods 29 on a side of the sub body 25 is deformed as shown in FIG. 5 through heat caulking such that a state where the main body 21, the seal 27, and the sub body 25 are assembled is permanently maintained.

As shown in FIG. 2, the center contact 9*a* is connected to an inner conductor of the cable 5, and the shield contact 11 is connected to an outer conductor of the cable 5. An end portion of the cable 5 is provided with the shield housing 13 that is configured to separate the center contact 9*a* and the shield contact 11 to maintain insulation therebetween, and is integrally formed with the second fastener 33 to be elastically connected to the second fastening portion 31 of the connector housing 1 while being pressed into the outer sheath of the cable 5 to form a locked state. The center contact 9*a* and the shield contact 11 are connected to a mating connector to form an electrically conductive state. The shield housing 13 is configured to form the insulation between the center contact 9*a* and the shield contact 11, and simultaneously prevent the cable 5 fixed to the connector housing 1 from being released using the second fastener 33.

As shown in FIG. 2, when the second fastener 33 of the shield housing 13 is connected to the second fastening portion 31 and the first fastener 19 of the sealing assembly 7 is connected to the first fastening portion 17, a rear end portion of the shield housing 13 is disposed in the immediate vicinity of a front end portion of the sub body 25 by a preset reference distance or less such that it comes into contact with the front end portion. In an embodiment, the reference distance may be approximately 0.1 millimeters (mm) to 0.3 mm. When the cable 5 is pulled backwards to be released from the connector housing 1, the rear end portion of the shield housing 13 comes into contact with the front end portion of the sub body 25, and the second fastener 33 and the first fastener 19 distribute a force of pulling the cable 5 backwards and support it. As a relative movement between the main body 21 and the sub body 25 is restricted by the connecting rods 29, and the connecting rods 29 transfer a force to be applied to the sub body 25 directly to the main body 21, the first fastener 19 may distribute and support the force to be applied to the sub body 25 as the cable 5 is pulled backwards.

As shown in FIG. 2, because the sub body 25 is fixed to the connector housing 1 to come into contact with the end portion of the shield housing 13, the sub body 25 may help distribute and support the force. When the cable 5 is pulled backwards, the sub body 25 may prevent the shield housing 13 from moving backwards and prevent the second fastener 33 from being damaged. In an existing waterproof structure, when a cable is pulled backwards, a shield housing may move by a distance by which an elastic seal is compressed, and thus a second fastener may be damaged, inviting a poor contact of a center contact by an external vibration. However, according to an example embodiment, the sub body 25 formed with a rigid material and the main body 21 connected thereto to perform a single rigid movement therewith may be supported from the connector housing 1 by the first fastener 19, and the sub body 25 may support directly a rear side of the shield housing 13. Dissimilar to the existing waterproof structure, the first fastener 19 formed in the shield housing 13 and the second fastener 33 formed in the sealing assembly 7 may together distribute and support the force of pulling the cable 5 backwards, instead of the seal 27 being compressed as the cable 5 is pulled backwards. Thus, according to an example embodiment, it is possible to prevent potential damage to components in the existing waterproof structure and a potential poor contact. For example, a diameter of the rod body 29*a* is greater than that of the tip hole 25*a*. Through such structure, an end portion of the rod body 29*a* supports an edge of the tip hole 25*a* as shown in FIGS. 4 and 5, and thus the force to be applied to the sub body 25 is transferred directly to the main body 21 through the connecting rods 29 when the cable 5 is pulled backwards. Accordingly, the first fastener 19, in addition to the second fastener 33, may also distribute and support the force of pulling the cable 5 backwards.

The cable 5 may not be readily released from the connector housing 1 by a force of pulling backwards by the connector housing 1, and thus the cable 5 may keep being connected to the connector housing 1 robustly and stably. In addition, in a situation described in the foregoing, the seal 27 may not be deformed by the connecting rods 29, and it is thus possible to maintain watertightness stably and improve durability of the seal 27.

A method of manufacturing the connector will now be described in greater detail with reference to FIGS. 3-8.

Figure 6:
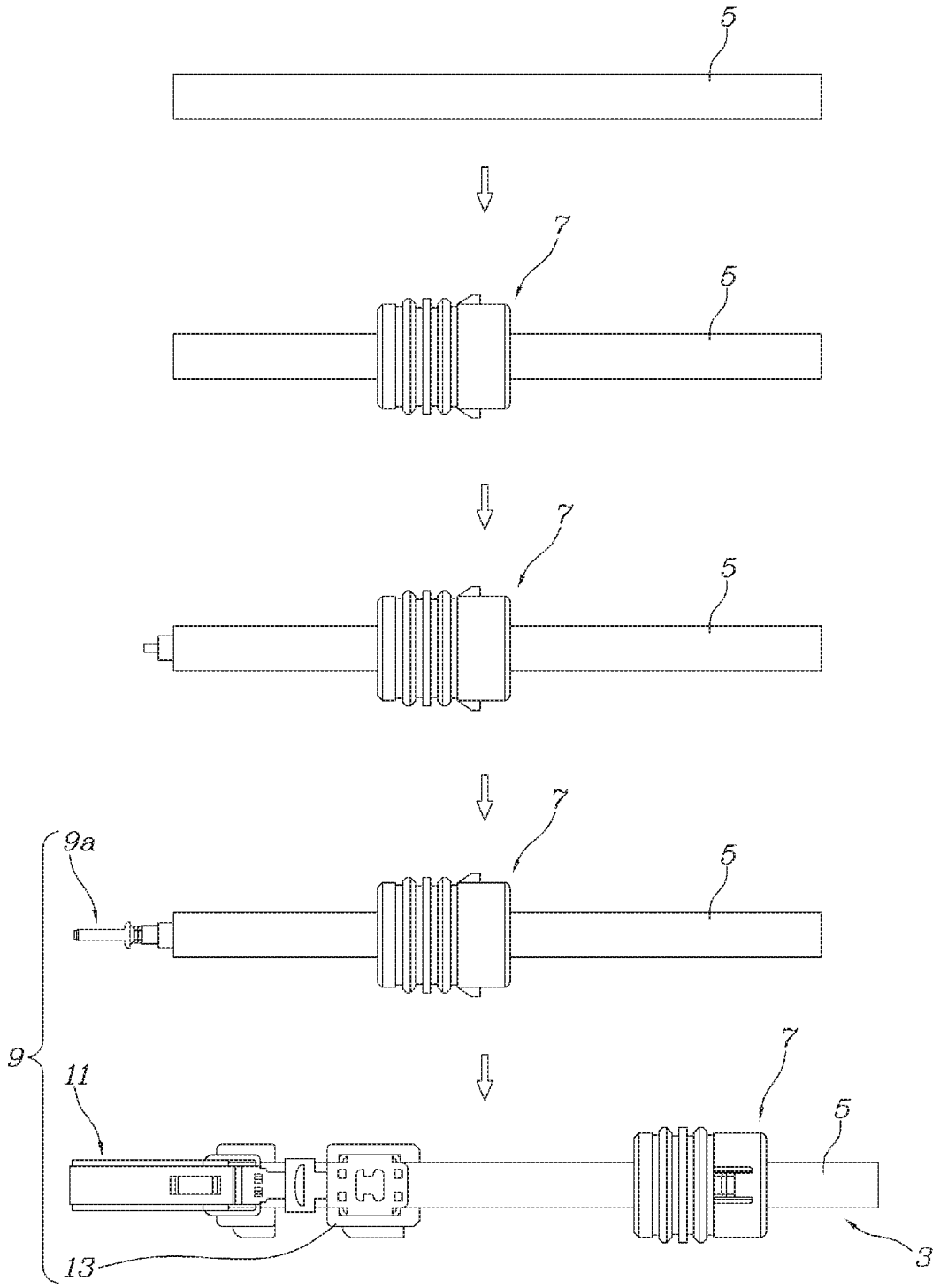
FIG. 6 is a top view of a sequence of assembling a cable assembly of the connector.
Figure 7:
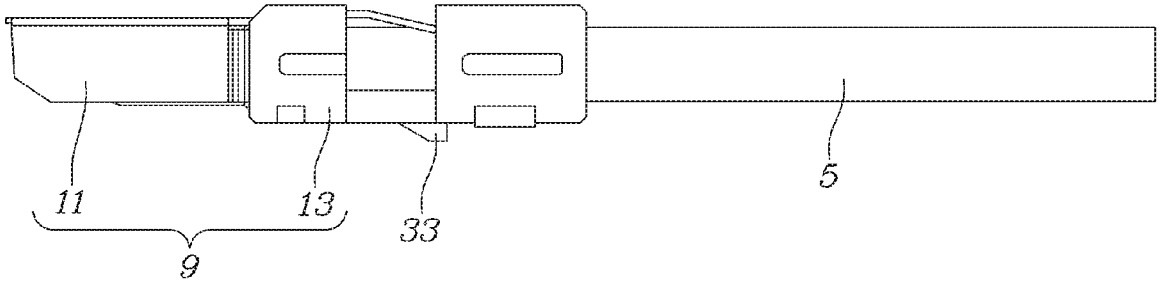
FIG. 7 is a side view of the cable assembly.
Figure 8:
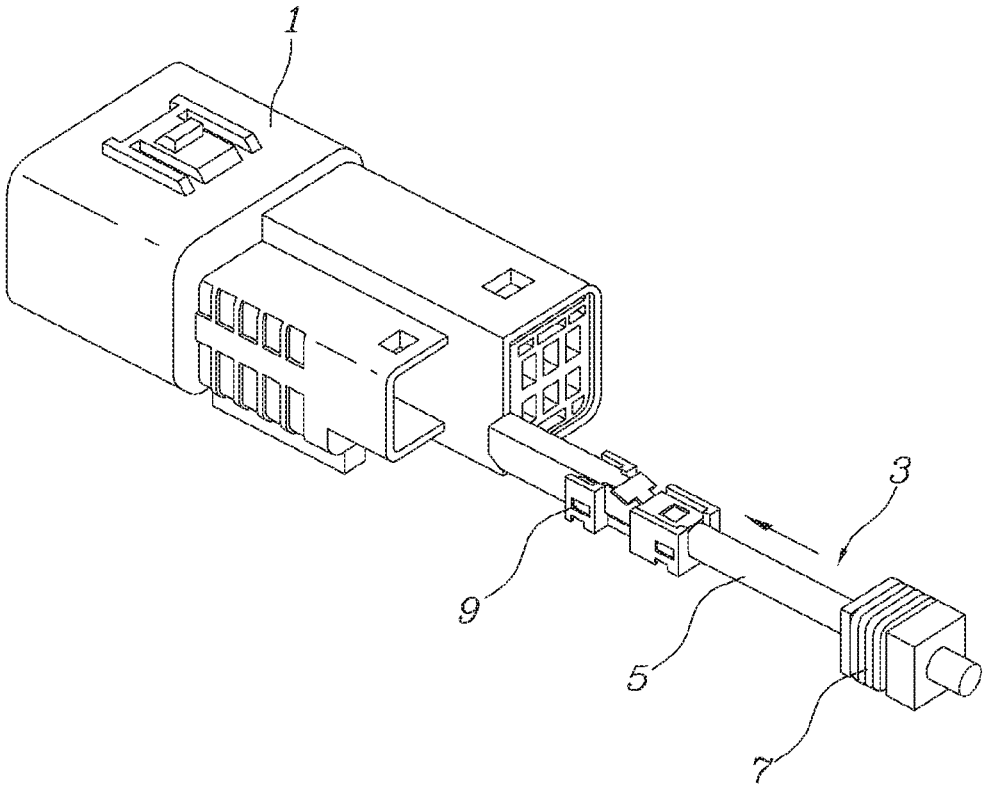
FIG. 8 is a perspective view of the cable assembly prior to insertion into a connector housing of the connector.

The method of manufacturing the connector includes an operation A of assembling the sealing assembly 7, shown in FIGS. 3-5, an operation B of inserting the sealing assembly 7 into the cable 5, shown in FIG. 6, an operation C of connecting the center contact 9*a* to the inner conductor of the cable 5, shown in FIG. 6, an operation D of connecting the shield contact 11 to the outer conductor of the cable 5, providing the shield housing 13 in the outer sheath of the cable 5, and forming insulation between the center contact 9*a* and the shield contact 11, shown in FIG. 6, and an operation E of connecting the connector assembly 3 to the connector housing 1, shown in FIG. 8. Unless otherwise stated, the order in which the operations A through E are performed is not limited to what has been described in the foregoing.

The operation A, as shown in FIGS. 3-5, is performed by sequentially connecting the seal 27 and the sub body 25 to the connecting rods 29 of the main body 21. In an embodiment, the operation A may be performed prior to the operation B. Through such structure, there is no need to install the seal 27 directly to an outer surface of the cable 5 for waterproof between the cable 5 and the connector housing 1. Thus, compared to a process of fixing the seal 27 to the cable 5 through clamping, it is possible to reduce an external force to be applied to the cable 5, and thus prevent a signal loss due to a deformation of the cable 5.

The operations C and D, shown in FIG. 6, are a series of operations for forming a coaxial cable connection structure at an end of the cable 5. The operation B may be performed prior to the operations C and D. When the operation B, and the operations C and D are performed, the connector assembly 3 is formed. That is, the connector assembly 3 is formed by connecting, to the cable 5, the sealing assembly 7, the center contact 9*a*, the shield contact 11, and the shield housing 13. In addition, the main body 21 of the sealing assembly 7 may be located farther from the center contact 9*a* than the sub body 25. The main body 21 may not include a hole penetrating along the longitudinal direction of the cable 5, other than the main hole 15.

In the operation E, shown in FIGS. 2 and 8, the two fasteners 19 and 33 provided in the connector assembly 3 are fastened to the two fastening portions 17 and 31 provided in the connector housing 1. The first fastener 19 formed in the main body 21 of the sealing assembly 7 is fastened to the first fastening portion 17 of the connector housing 1, and the second fastener 33 formed in the shield housing 13 is fastened to the second fastening portion 31 of the connector housing 1. In addition, the sub body 25 located in the end portion of the sealing assembly 7 supports the shield housing 13. Through this double fastening or locking structure that enables the activation of mutual forces, it is possible to distribute and support a force of pulling the cable 5 backwards.

According to example embodiments described herein, it is possible to minimize the number of working processes to assemble a cable into a connector, and thus improve productivity and reduce costs. In addition, it is possible to achieve a desirable level of waterproofing performance and a robust and stable connection of the cable.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A connector, comprising:

a connector housing; and a cable assembly configured to be inserted into the connector housing and fixed to the connector housing, the cable assembly including a cable, a terminal portion configured to electrically connect the cable to an external terminal, and a sealing assembly pressed into an outer sheath of the cable and forming a watertight seal with the cable, the sealing assembly is disposed separately from the terminal portion and includes a main body having a main hole through which the cable passes and a connecting rod extending in a longitudinal direction of the cable, a seal having a cable hole through which the cable passes and a body hole through which the connecting rod passes, and a sub body having a subhole through which the cable passes and a tip hole into which an end portion of the connecting rod is inserted, the cable assembly is elastically connected to a first fastening portion of the connector housing.

2. The connector of claim 1, wherein the cable passes through the main hole in a central portion of the main body, and wherein the sealing assembly further includes a first fastener configured to be elastically connected to the first fastening portion is integrally formed on the main body and faces the first fastening portion.

3. The connector of claim 2, wherein the cable passes through the subhole in a central portion of the sub body, the sub body is connected to the main body.

4. The connector of claim 3, wherein the seal is interposed between the main body and the sub body, the seal is pressed into the outer sheath of the cable to form the watertight seal.

5. The connector of claim 4, wherein the sealing assembly includes a plurality of connecting rods extending through the seal, a pair of ends of each of the plurality of connecting rods are fixed to the main body and the sub body, connecting the main body, the seal, and the sub body.

6. The connector of claim 5, wherein the plurality of connecting rods are integrally formed with the main body and protrude parallel to each other from an area around the main hole towards an area around the subhole of the sub body.

7. The connector of claim 6, wherein an end portion of each of the plurality of connecting rods extending through the sub body is fixed to the sub body through heat caulking.

8. The connector of claim 5, wherein the terminal portion has a center contact connected to an inner conductor of the cable, a shield contact connected to an outer conductor of the cable, and a shield housing at an end portion of the cable, the shield housing separating the center contact and the shield contact.

9. The connector of claim 8, wherein the shield housing is integrally formed with a second fastener elastically connected to a second fastening portion of the connector housing.

10. The connector of claim 9, wherein when the second fastener of the shield housing is connected to the second fastening portion and the first fastener of the sealing assembly is connected to the first fastening portion, a rear end portion of the shield housing is disposed adjacent to a front end portion of the sub body by a reference distance or less.

11. The connector of claim 1, wherein the terminal portion has a center contact connected to an inner conductor of the cable, a shield contact connected to an outer conductor of the cable, and a shield housing at an end portion of the cable, the shield housing separating the center contact and the shield contact.

12. The connector of claim 11, wherein the sealing assembly has a first fastener configured to be connected to the first fastening portion and the shield housing has a second fastener configured to be connected to a second fastening portion of the connector housing.

13. The connector of claim 12, wherein an end portion of the sealing assembly supports the shield housing.

14. The connector of claim 1, wherein the connecting rod has a rod body extending from the main body and inserted through the body hole, and a rod tip extending from the rod body and inserted into the tip hole.

15. The connector of claim 14, wherein the rod body has a diameter greater than a diameter of the tip hole.

16. A method of manufacturing a connector, comprising:

assembling a sealing assembly;

inserting the sealing assembly onto a cable after assembling the sealing assembly, the sealing assembly includes a main body having a main hole through which the cable passes and a connecting rod extending in a longitudinal direction of the cable, a seal having a cable hole through which the cable passes and a body hole through which the connecting rod passes, and a sub body having a subhole through which the cable passes and a tip hole into which an end portion of the connecting rod is inserted;

providing a terminal portion in the cable to electrically connect the cable to an external terminal; and forming a connector assembly by combining a connector housing, the sealing assembly, and the terminal portion, the sealing assembly is elastically connected to a first fastening portion of the connector housing to lock the sealing assembly to the connector housing, the sealing assembly is disposed separately from the terminal portion.

17. The method of claim 16, wherein the assembling step includes:

combining the main body, the seal, and the sub body in a sequential order; and fixing the connecting rod to the top hole by widening and deforming the end portion of the connecting rod in a radial direction through heat caulking.

18. A connector, comprising:

a connector housing; and a cable assembly configured to be inserted into the connector housing and fixed to the connector housing, the cable assembly including a cable, a terminal portion configured to electrically connect the cable to an external terminal, and a sealing assembly pressed into an outer sheath of the cable and forming a watertight seal with the cable, the sealing assembly is disposed separately from the terminal portion, the cable assembly is elastically connected to a first fastening portion of the connector housing, wherein the terminal portion has a center contact connected to an inner conductor of the cable, a shield contact connected to an outer conductor of the cable, and a shield housing at an end portion of the cable, the shield housing separating the center contact and the shield contact, and wherein the sealing assembly has a first fastener configured to be connected to the first fastening portion and the shield housing has a second fastener configured to be connected to a second fastening portion of the connector housing.

* * * * *